United States Patent [19]

Shelfantook et al.

[11] Patent Number: 4,859,317

[45] Date of Patent: Aug. 22, 1989

[54] PURIFICATION PROCESS FOR BITUMEN FROTH

[76] Inventors: William E. Shelfantook, #1, 11115-27 Avenue, Edmonton, Alberta, T6J 5H3; Alexander W. Hyndman, 168 Brosseau Crescent, Fort McMurray, Alberta, T9K 1T2; Larry P. Hackman, 16, Flint Crescent, St. Albert, Alberta, T8N 1Y8, all of Canada

[21] Appl. No.: 151,011

[22] Filed: Feb. 1, 1988

[51] Int. Cl.[4] ..... C10C 3/00; C10C 3/08; C10C 3/10

[52] U.S. Cl. ..... 208/391; 208/425; 208/177; 210/712; 210/727; 210/729; 210/738; 210/521

[58] Field of Search ..... 208/177, 391, 425; 210/710, 712, 729, 738, 727, 521, 522; 209/10, 164

[56] References Cited

U.S. PATENT DOCUMENTS

| | | | |
|---|---|---|---|
| 2,573,615 | 10/1951 | Seailles | 210/521 |
| 3,808,120 | 4/1974 | Smith | 208/425 |
| 4,035,282 | 7/1977 | Stuchberry | 208/391 |
| 4,040,958 | 8/1977 | Rammler | 208/177 |
| 4,110,195 | 8/1978 | Harding | 210/521 |
| 4,115,279 | 9/1978 | Toft | 210/521 |
| 4,122,016 | 10/1978 | Tao | 210/521 |
| 4,358,373 | 11/1982 | Jubenville | 208/425 |
| 4,747,948 | 5/1988 | North | 210/521 |

FOREIGN PATENT DOCUMENTS

| | | | |
|---|---|---|---|
| 857306 | 12/1970 | Canada | 208/425 |
| 952844 | 8/1974 | Canada | 208/425 |

*Primary Examiner*—Kenneth M. Schor
*Assistant Examiner*—Thomas M. Lithgow
*Attorney, Agent, or Firm*—Millen, White & Zelano

[57] ABSTRACT

Bitumen froth is treated in a circuit comprising a plurality of serially connected mixer and inclined plate settler units. A light hydrocarbon diluent moves countercurrently through the circuit. Thus, as the bitumen content of the stream being settled diminishes, the concentration of diluent in that stream increases.

1 Claim, 2 Drawing Sheets

PURIFICATION PROCESS FOR BITUMEN FROTH

FIELD OF THE INVENTION

This invention relates to a process for purifying bitumen froth, to thereby obtain a diluted bitumen stream of good enough quality to be fed to a downstream upgrading facility. By 'purifying' is meant that water and solids present in the froth are separated from the bitumen.

BACKGROUND OF THE INVENTION

The oil sands of the Fort McMurray region of Alberta are presently being exploited by two large commercial operations. The process practiced in these operations involves four broad steps, namely:

mining the oil sand;

extracting the bitumen from the mined oil sand using a process known as the 'hot water process', to produce bitumen in the form of a froth contaminated with water and solids;

purifying the froth to separate the water and solids from the bitumen; and upgrading the purified bitumen in a coking facility to produce products which are suitable for a conventional refinery.

The present invention has to do with the purifying step. However, in order to understand the problems solved by the invention, it is first necessary to review the steps of the hot water process and the conventional froth purification process.

As a beginning point, it needs to be understood that oil sands comprises relatively large quartz sand grains, each grain being encapsulated in a thin sheath of connate water. The water contains minute clay particles (referred to as 'fines'). The bitumen is positioned in the interstices between the water-sheathed grains of sand.

In the first step of the hot water process, the mined oil sand is mixed in a rotating horizontal cylindrical drum (or 'tumbler') with hot water (80° C.) and a small amount of NaOH (referred to as 'process aid'). Steam is sparged into the slurry at intervals along the length of the drum, to ensure that the exit temperature of the resultant slurry is about 80° C.

The drum is slightly inclined along its length, so that the mixture moves steadily therethrough. The retention time is about 4 minutes.

This tumbling step is referred to as 'conditioning'. It involves heating of the bitumen and displacement, by water addition, of the bitumen away from the sand grains. Many of the released bitumen globules become aerated by forming films around air bubbles entrained in the tumbler slurry. Conditioning also involves reaction between the NaOH and bitumen to produce surfactants which facilitate the bitumen-release and subsequent flotation/settling steps.

On leaving the tumbler, the conditioned slurry is screened, to remove oversize rocks and lumps, and diluted with additional hot water. The resulting water/-bitumen ratio is about 6:1.

The diluted slurry is then introduced into a large thickener-like vessel having a cylindrical upper portion and a conical lower portion. The vessel is referred to as the 'primary separation vessel' or 'PSV'. Here the diluted slurry is retained for about 45 minutes under quiescent conditions. Under the influence of gravity, the sand grains sink, are concentrated in the conical portion and are discharged as 'primary tailings' through a valve and line connected to the lower apex of the vessel. The bitumen globules, rendered buoyant by air attachment, rise to the surface of the PSV and form a froth. This froth is called 'primary froth' and typically comprises:

66.4% by wt. bitumen
24.7% by wt. water
8.9% by wt. solids

The primary froth is skimmed off and recovered in a launder. In between the layer of sand tailings in the base of the vessel and the layer of froth at the top, there exists a watery slurry referred to as 'middlings'. The middlings contain fines and globules of bitumen which are insufficiently buoyant to reach the froth layer.

A stream of middlings is continuously withdrawn from the PSV. These middlings are treated in a series of sub-aerated flotation cells. In these cells, the middlings are vigorously aerated and agitated, with the result that contained bitumen is forced to float and form a dirty froth referred to as 'secondary froth'. This secondary froth typically comprises:

23.8% by wt. bitumen
58.7% by wt. water
17.5% by wt. solids.

To reduce the concentration of water and solids in the secondary froth, it may be retained in a settling tank to allow some of the contaminants to settle out. The 'cleaned' secondary froth typically comprises:

41.4% by wt. bitumen
46.2% by wt. water
12.4% by wt. solids.

The primary and secondary froths are then combined to provide the product of the hot water extraction process. The 'combined froth' typically comprises:

57.3% by wt. bitumen
34.2% by wt. water
8.4% by wt. solids.

This stream is too contaminated to be used as feed to the downstream upgrading circuit. This latter circuit requires a feed typically comprising:

99.0% by wt. bitumen
% by wt. water
1.0% by wt. solids.

So the combined froth product requires purification (or water and solids removal) before it can be fed to the upgrading circuit. Heretofore, this purification has been obtained by using what is referred to as 'two stage dilution centrifuging'. This operation involves:

1. Diluting the combined froth with naphtha. This is done to reduce hydrocarbon phase viscosity and increase the density difference between the hydrocarbon phase (bitumen dissolved in naphtha) and the water and solids phase (referred to jointly as 'sludge');

2. Passing the diluted froth through a low-speed scroll centrifuge, to remove the coarse solids and some of the water as a cake, which is discarded; and 3. Passing the scroll centrifuge product through a high-speed disc centrifuge to remove fine solids and most of the balance of the water. The disc centrifuge product typically analyzes at:

59.4% by wt. bitumen
37.5% by wt. naphtha
4.5% by wt. water 0.4% by wt. solids

The naphtha diluent and any contained water is then distilled out of the disc centrifuge product to produce the purified bitumen product for advancing to the upgrading process.

The described dilution centrifuging process has been used because it is capable of producing a bitumen product of the desired quality. But it is an operation that is exceedingly expensive to maintain and operate due to the erosive nature of the feed and the rotating character of the centrifuges. For example, in use, the flights of the scroll centrifuges wear badly, even though they are formed of ceramic, and the brittle ceramic flights commonly break and put the machine out of balance. In the case of the disc centrifuges, their sludge discharge nozzles are subject to rapid wear and the separation interface between product and reject in the stack of discs can easily be 'lost', with the result that a significant amount of bitumen is lost with the tailings. In addition, a large number of the machines must be used, with attendant consumption of very large amounts of electrical energy.

Thus, there has long been a need for a viable alternative to the dilution centrifuging circuit for purifying bitumen froth.

The present invention involves a circuit of interconnected known devices, namely mixers and inclined plate settlers ('IPS').

An inclined plate settler comprises a stack of parallel, spaced apart, solid plates, inclined downwardly from the horizontal and mounted within a containing vessel. Each space between a pair of plates forms a discrete settling zone. The feed mixture to be separated is distributed into the spaces, at a point between their longitudinal ends. The light components of the mixture rise to the underside surface of the upper plate. These light components then travel up said underside surface and are collected and recovered at the upper ends of the plates. The heavy components of the mixture sink towards the uppermost surface of the lower plate and follow it downwardly, to be collected and recovered at the lower ends of the plates.

A mixer can take any of various forms—the present work involved simply a cylindrical container having a submerged driven impeller positioned therein.

SUMMARY OF THE INVENTION

The present invention is based on the following experimentally determined observations:

That bitumen froth is amenable to high quality separation in a first IPS, but in that first stage of separation only part of the bitumen in the feed reports as overhead product;

That the underflow from the first IPS, containing a significant proportion of the bitumen in the original feed, is not amenable to high quality separation in a second IPS. It appears that the first stage underflow contains stable emulsions that will not readily resolve in the second IPS or that much of the hydrocarbons that did not report to the overflow in the first stage will also not report to the overflow in the second stage; and That if light hydrocarbon diluent (e.g. naphtha) is mixed with the first stage underflow, then this mixture is amenable to good quality separation in the second IPS.

Having conceived and tried the underlying experimental work that resulted in these observations, applicants conceived a purification circuit for bitumen froth that would incorporate the following features:

the use of a plurality of serially connected inclined plate settlers, with a subsequent settler being fed the underflow from a preceding settler;

the addition of light hydrocarbon diluent or solvent, in a progressively richer concentration, to the bitumen-containing stream moving through the series of settlers, said bitumen-containing stream becoming progressively leaner in bitumen as it moves through the circuit; and the use of mixers before each settler to mix the added diluent with the bitumen.

A circuit or line consisting of three pairs of alternating mixers and settlers was tested. The overflow stream from the first settler provided the only bitumen product stream produced from the circuit. The bitumen/diluent overflow stream from the second settler was recycled to the first mixer to be combined with the froth feed. The low-bitumen/high-diluent overflow stream from the third settler was recycled to the second mixer. Thus more diluent was supplied to the relatively bitumen-lean underflow stream being supplied to the second mixer. And finally, fresh diluent was supplied to the third mixer to dissolve the small amount of bitumen in the underflow stream of the second settler.

When applied to typical combined bitumen froth this circuit demonstrated:

that the bitumen product stream from the first IPS was of the same order of purity as that derived from a conventional dilution centrifuging circuit; and that the recovery of bitumen by the test circuit was of the same order as that obtained by dilution centrifuging.

Stated otherwise, we have made the surprising discovery that a process using three mixing/IPS separation steps in series, combined with a counter flow of solvent, gives product of as good quality as that obtained from the centrifuge process (said quality being referred to as "upgrading quality"), together with comparable hydrocarbon recovery and a sludge tailings that is substantially hydrocarbon-free. And the components of the present circuit are without moving parts (except for the pumps and impellers) and thus are characterized by comparatively low maintenance costs.

DESCRIPTION OF THE PREFERRED EMBODIMENT

Figure 1:
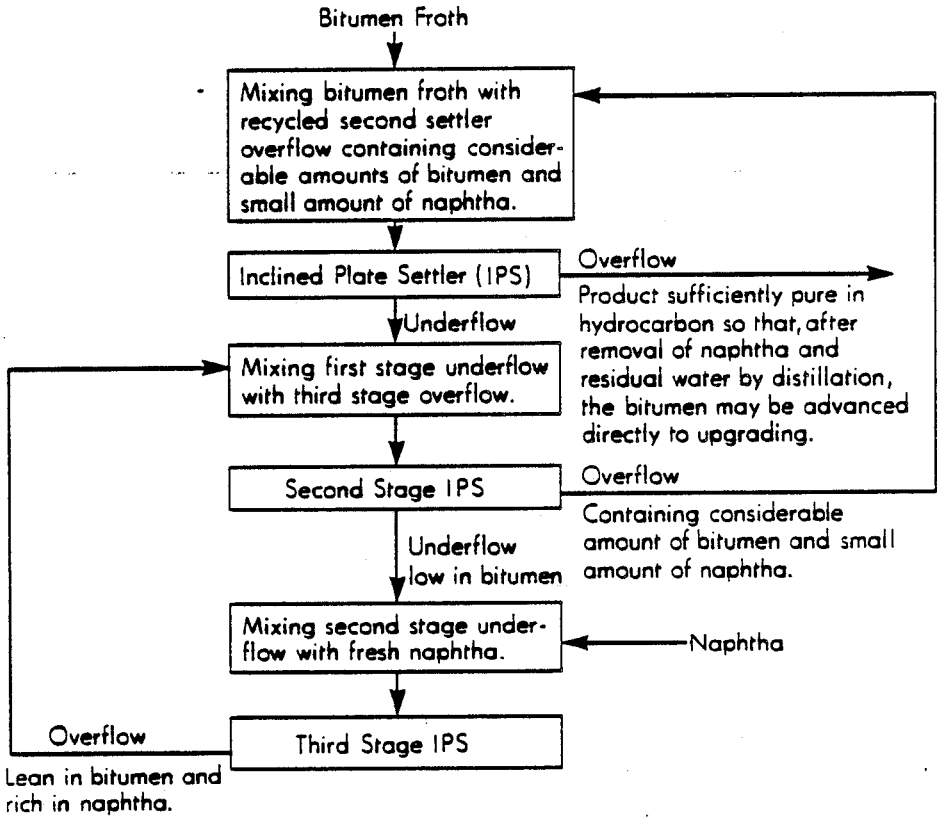
FIG. 1 is a block diagram showing the steps of the process in accordance with the preferred embodiment.
Figure 2:
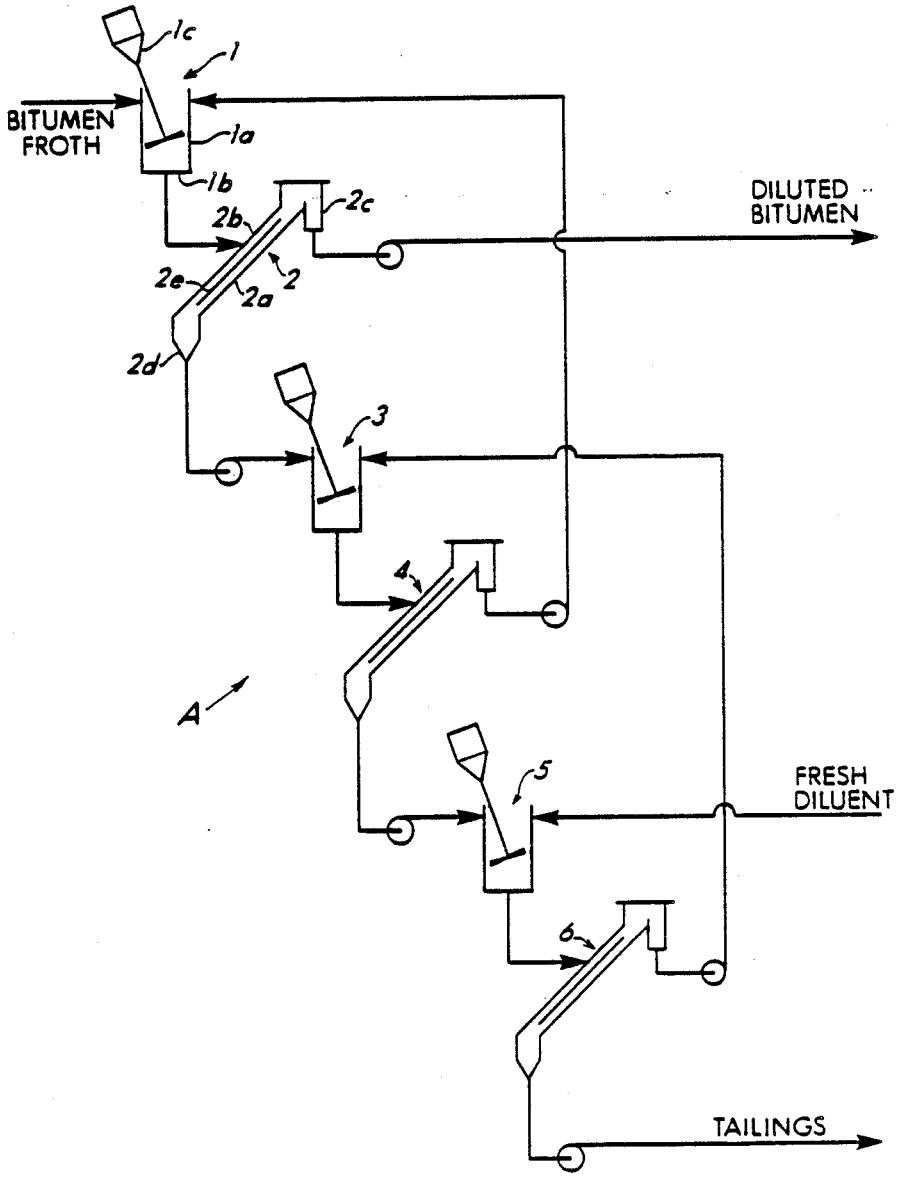
FIG. 2 is a schematic showing the circuit of processing components or units and their pipe interconnections.

The test work underlying the present invention was carried out in 3-stage mixer/IPS circuit. The invention will now be described with respect to that circuit, although it could also be conducted in 2, 4 or even more stages.

More particularly, combined bitumen froth was fed to a circuit A comprising: a first mixer 1; a first IPS 2; a second mixer 3; a second IPS 4; a third mixer 5; a third IPS 6; and appropriate connecting lines.

The combined froth was introduced into and mixed in the first mixer 1 with a first recycled overhead stream from the second IPS 4. This first recycled overhead stream was depleted in bitumen but enriched in naphtha, relative to the combined froth feed.

The first mixer 1 comprised a cylindrical body 1*a* having a flat bottom 1*b*. An impeller 1*c* was positioned to stir the contents of the mixer.

The mixture from the first mixer 1 was fed to the inlet of the first IPS 2. The first IPS 2 was simply a box 2*a* having an inlet 2*b*, an overhead outlet 2*c*, and an underflow outlet 2*d*. The box contained a pair of inclined spaced-apart plates 2*e*.

The dimensions of the mixer and IPS units used are set forth in Table 1. The several mixers and IPS's in the circuit were identical to the described units.

TABLE I

| | |
|---|---|
| Length of IPS | 5' |
| Spacing between plates | 1½" |
| Dimensions of plates | 5'× 1' |
| Mixer vessel | 12" diameter<br>12" to 16" of liquid in the vessel during operation |
| Type of impellor | 6" diameter marine propeller |
| Impellor rpm | 220–680 |

Separation of the bitumen, water, and solids, present in the mixture fed from the first mixer 1, took place in the first IPS 2. A first overhead product stream, which was the only bitumen-rich product from the circuit, was obtained. This stream was enriched in bitumen relative to the original froth feed. (The compositions of these streams are set forth in Table II below.)

The underflow stream from the first IPS 2 was fed to the second mixer 3. Here it was mixed with a second recycled stream from the third IPS 6. This second recycled stream was very depleted in bitumen but relatively rich in naphtha.

The mixture from the second mixer 3 was fed to the inlet of the second IPS 4. Separation occurred therein and overflow and underflow streams were produced. The overflow stream was the stream recycled to the first mixer, as previously stated.

The second underflow stream, produced by the second IPS 4, was fed to the third mixer 6. This second underflow stream was quite lean in bitumen—more particularly, it was depleted in bitumen relative to the first underflow stream.

In the third mixer 6, the second underflow stream was mixed with fresh pure naphtha. The mixture was fed to the inlet of the third IPS 6 and underwent separation therein. The overflow stream from the third IPS 6 was recycled to the second mixer 3, as previously stated. The underflow stream, virtually free of bitumen, was discarded as tails.

The stream compositions and separation results are set forth in Table II.

TABLE II

| | COMPOSITION (% BY WT.) | | | | |
|---|---|---|---|---|---|
| STREAM | BITUMEN | WATER | SOLIDS | NAPHTHA | RATE kg/min |
| Combined froth feed | 57.3 | 34.2 | 8.5 | — | 1.96 |
| First recycled overflow (from 2nd. IPS) | 19.7 | 14.1 | 1.9 | 63.4 | 1.59 |
| Overflow product (from 1st IPS) | 55.7 | 4.7 | 0.7 | 39.0 | 2.02 |
| 1st IPS underflow | 20.7 | 52.7 | 12.1 | 14.5 | 1.52 |
| Second recycled overflow (from 3rd IPS) | 2.80 | 53.8 | 8.3 | 35.1 | 3.01 |
| 2nd IPS underflow | 2.9 | 13.7 | 74.6 | 9.3 | 2.95 |
| Fresh diluent | | | | 99.5 | 0.81 |
| 3rd IPS underflow | 0.20 | 77.3 | 20.3 | 2.4 | 0.75 |

The embodiments of the invention in which an exclusive property or privilege is claimed are defined as follows:

1. A process for purifying bitumen froth from the hot water process for extracting bitumen from oil sand, said froth comprising bitumen, water and solids, said process being carried out in a circuit comprising first, second and third inclined plate settlers and first, second and third mixers, each settler having an inlet, an overflow outlet and an underflow outlet, each mixer having an inlet and outlet, each mixer being positioned before the corresponding settler, the outlet of each mixer being connected with the inlet of the immediately downstream settler, the inlet of the first mixer being connected with a source of bitumen froth, the inlet of the second mixer being connected with the underflow outlet of the first settler, the inlet of the third mixer being connected with the underflow outlet of the second settler, the overflow outlet of the first settler providing the diluted bitumen product from the circuit, the overflow outlet of the second settler being connected with the first mixer, the overflow outlet of the third settler being connected with the second mixer, the third mixer being connected with a source of light hydrocarbon diluent, said process comprising:

mixing the bitumen froth in the first mixer with a first recycled overflow stream from the second settler, said overflow stream being depleted in bitumen and enriched in diluent relative to the froth;

treating the mixture produced from the first mixer in the first settler to produce a first product overflow stream which is sufficiently enriched in bitumen relative to the froth to be of upgrading quality and a first underflow stream which is depleted in bitumen relative to the froth;

mixing the first underflow stream from the first settler in the second mixer with a second recycled overflow stream from the third settler, said second overflow stream being depleted in bitumen and enriched in diluent relative to the first overflow stream;

treating the mixture produced from the second mixer in the second settler to produce the first recycled overflow stream and a second underflow stream which is depleted in bitumen relative to the first underflow stream;

mixing the second underflow stream from the second settler in the third mixer with a stream of light hydrocarbon diluent from said source of light hydrocarbon;

treating the mixture produced from the third mixer in the third settler to produce the second recycled overflow stream and a third underflow stream which is depleted in bitumen relative to the second underflow stream.

* * * * *